US009375074B2

(12) United States Patent
Moreau et al.

(10) Patent No.: US 9,375,074 B2
(45) Date of Patent: Jun. 28, 2016

(54) CLIP FOR ATTACHING ARTICLES TOGETHER

(76) Inventors: Darrell A. Moreau, Manchester, NH (US); Andre W. Moreau, Spring Hill, FL (US)

( * ) Notice: Subject to any disclaimer, the term of this patent is extended or adjusted under 35 U.S.C. 154(b) by 520 days.

(21) Appl. No.: 12/957,688

(22) Filed: Dec. 1, 2010

(65) Prior Publication Data

US 2012/0141050 A1 Jun. 7, 2012

(51) Int. Cl.

| | |
|---|---|
| ***B65D 30/08*** | (2006.01) |
| ***A45F 5/02*** | (2006.01) |
| ***A45F 5/06*** | (2006.01) |
| ***A45F 5/10*** | (2006.01) |

(52) U.S. Cl.

CPC . *A45F 5/02* (2013.01); *A45F 5/021* (2013.01); *A45F 5/06* (2013.01); *A45F 5/102* (2013.01); *A45F 2005/028* (2013.01); *A45F 2005/1086* (2013.01); *Y10T 24/31* (2015.01); *Y10T 24/44376* (2015.01); *Y10T 29/49826* (2015.01)

(58) Field of Classification Search

CPC ..... A45F 5/06; A45F 5/102; A45F 5/021; A45F 5/02; F16B 2/22; Y10T 24/44556; Y10T 24/45173; Y10T 24/44769; Y10T 24/45262; Y10T 24/344; Y10T 24/4599; Y10T 24/45995; A44C 5/2057; A44C 5/2061

USPC ..... 224/934, 666; 383/109, 43, 49, 51, 905, 383/112; 24/298, 300, 499, 428, 336, 338, 24/545, 341, 552, 553, 684

See application file for complete search history.

(56) References Cited

U.S. PATENT DOCUMENTS

| | | | | | |
|---|---|---|---|---|---|
| 867,255 | A | * | 10/1907 | Dietz | A45F 5/02 24/3.6 |
| 2,743,894 | A | * | 5/1956 | Ostnas | 248/317 |
| 2,839,597 | A | * | 6/1958 | Hendrix | 174/146 |
| 4,312,089 | A | * | 1/1982 | Taylor | 441/32 |
| 5,069,261 | A | * | 12/1991 | Ji | 150/150 |
| 5,263,577 | A | * | 11/1993 | Paratte et al. | 206/38.1 |

(Continued)

FOREIGN PATENT DOCUMENTS

| | | | |
|---|---|---|---|
| EP | 1723871 | A2 | 11/2006 |
| WO | 2005020738 | A1 | 3/2005 |

OTHER PUBLICATIONS

PCT International Search Report for PCT/US2011/022803, mailed Feb. 8, 2012.

(Continued)

*Primary Examiner* — Jes F Pascua
*Assistant Examiner* — Matthew Theis
(74) *Attorney, Agent, or Firm* — Robert R. Deleault, Esq.; Mesmer & Deleault, PLLC

(57) ABSTRACT

A clip system includes a first resilient clip member having a curved rear wall portion and finger gripping portions sufficiently resilient that when pressed together by the fingers of an operator, the jaw portions will open and when released will be urged toward an abutted condition, the curved rear wall portion having a first aperture with a concave recess at an outer surface, a slot extending from the first aperture to a second aperture located a predefined distance from the first aperture where the slot is narrower than the first aperture and the second aperture, and a detent connected to the clip member and adjacent to the slot, and a tether member rotationally and pivotally connected to and retained in the first aperture.

17 Claims, 14 Drawing Sheets

(56) References Cited

U.S. PATENT DOCUMENTS

| | | | | |
|---|---|---|---|---|
| 5,623,980 | A * | 4/1997 | McMahon | 150/150 |
| 5,687,458 | A * | 11/1997 | Coker | 24/336 |
| 5,774,957 | A * | 7/1998 | Kohl et al. | 24/701 |
| 6,264,522 | B1 * | 7/2001 | Dickson | 446/120 |
| 6,722,317 | B2 * | 4/2004 | O'Rourke | 119/707 |
| 7,581,292 | B2 | 9/2009 | Votel | |
| 2003/0038150 | A1 * | 2/2003 | Williams | 224/401 |
| 2006/0032029 | A1 | 2/2006 | Nessel et al. | |
| 2010/0018013 | A1 * | 1/2010 | Vermillion et al. | 24/520 |

OTHER PUBLICATIONS

European Extended Search Report and Written Opinion for EP Appl. No. 11 845 755.5 dated May 9, 2014.

* cited by examiner

CLIP FOR ATTACHING ARTICLES TOGETHER

BACKGROUND OF THE INVENTION

1. Field of the Invention

The present invention relates generally to devices for securing unused articles to a user. Particularly, the present invention relates to clips.

2. Description of the Prior Art

In many industrial environments, requirements for personal protective equipment are becoming more prevalent. In most industrial plants, safety equipment (hard hats, safety glasses, gloves, ear plugs, etc.) are typically supplied through issue counters or dispensing units located throughout the plant. Even with these procedures in place, many companies are enforcing that employees/contractors maintain their safety equipment on their person when working in plant areas.

Glove use when working can be drastically minimized injuries thus reducing insurance costs, medical costs, and loss of production for the employer. Many industrial sites are requiring not only the use of gloves for any type of work but also enforcing employees to have gloves readily available. This typically means the gloves must be in their possession.

The same concerns apply for hearing protection. The most common means for hearing protection are the sponge style ear plugs which are typically available from dispensing units at the entrance points into the plant. Often times, workers forget to obtain a pair of ear plugs or may not be intending to enter a high noise area. In either case, the worker would have to return to the dispensing site to obtain a set of ear plugs. Most of the ear plugs are placed in the workers pocket where it could collect lint or foreign matter which could be detrimental to the ear if the ear plug is installed. Canisters with a chain strap that can be buckled to a hard had (if used) or tied to a hard hat when using the tethered style ear plugs are another means of carrying the ear plugs.

Therefore, what is needed is a clip for attaching articles together. What is further needed is a clip for attaching articles together and store ear plugs.

SUMMARY OF THE INVENTION

The present invention achieves these and other objectives by providing a clip system. The system includes a first resilient clip member having an upper and a lower generally rectangular longitudinal finger grip portion diverging forwardly from a curved rear wall portion in opposed relation. A narrow rectangular portion extends at a forward end of the rectangular finger grip portion in laterally opposed crossed relation. An upper and a lower L-shaped jaw portion extends from the narrow rectangular portion, each of which is wider than the narrow rectangular portion. Each of the finger grip portions is sufficiently resilient such that when pressed together by the fingers of an operator, the jaw portions will open and when released will be urged toward the abutted condition. The curved rear wall portion has a first aperture with a concave recess at an outer surface and a slot extending from the first aperture to a second aperture located in the finger grip portion adjacent the rear curved end. The lateral slot is narrower than the first aperture and the second aperture. The system also includes a tether member having a central shank portion of a first diameter, a neck portion on an end of the central shank portion, and an end portion connected to the neck portion. The neck portion has a second diameter that is narrower than the central shank portion and a thickness smaller than the lateral slot in the first clip member. The end portion is larger than the lateral slot and the first aperture but smaller than the second aperture so that the neck portion extends through the first aperture of the first clip member where the end portion is disposed adjacent an inward side of the rear wall portion to retain the clip member on the tether member in an axially opposed relation and allow relative rotational and pivotal movement between the clip member and the tether member.

In another embodiment of the present invention, the first clip member includes a detent adjacent the slot. In one embodiment of the detent, the detent is a bendable member spatially positioned adjacent the slot on an inward side of the clip member a predefined distance wherein the bendable member flexes to permit ingress of the end portion of the tether member from the second aperture to the inward side of the first aperture in the curved end and to restrict egress of the end portion back to the second aperture. In a second embodiment, the detent is a lip on a slot wall wherein the lip forms a slot portion that is narrower than the neck portion of the tether member to permit ingress of the end portion of the tether member from the second aperture to the inward side of the curved end and to restrict egress of the end portion back to the second aperture.

In a further embodiment of the present invention, the clip system includes an openable container having a receiver component connected to the tether member and a container entrance movable between a normally restricted position to an open position. In a first embodiment of the openable container, the openable container is a resilient pouch having with an elongated container entrance. The elongated container entrance has a first entrance end, a second entrance end and an elongated entrance therebetween providing restricted access to an inside of the resilient pouch wherein forcing the first entrance end toward the second entrance end provides unrestricted access to the inside of the resilient pouch.

In still another embodiment of the openable container, the elongated entrance is in an end of the resilient pouch. In another embodiment, the elongated entrance is in a side of the resilient pouch.

In yet another embodiment of the openable container, the openable container includes an outer sleeve and an inner housing defining an inside container volume where the inner housing has an opening communicating with the inside container volume and where the entrance provides restricted access to the inside container volume when the outer sleeve and the inner housing are in a closed position and where the entrance provides unrestricted access to the inside container volume when the outer sleeve and the inner housing are in an open position.

In another embodiment of the present invention, the tether member has a stop on the central shank portion.

In yet another embodiment of the present invention, the clip system includes a floatation component connected to the tether member to provide floatation means to keep the clip system 10 afloat if clip system 10 is inadvertently or accidently dropped into water or other liquid.

In a further embodiment of the present invention, the clip system includes a second clip member having an upper and a lower generally rectangular longitudinal finger grip portion diverging forwardly from a curved rear wall portion in opposed relation. A narrow rectangular portion extends at a forward end of the rectangular finger grip portion in laterally opposed crossed relation. An upper and a lower L-shaped jaw portion extends from the narrow rectangular portion, each of which is wider than the narrow rectangular portion. Each of the finger grip portions is sufficiently resilient such that when pressed together by the fingers of an operator, the jaw portions will open and when released will be urged toward the abutted condition. The curved rear wall portion has a first aperture with a concave recess at an outer surface and a slot extending from the first aperture to a second aperture located in the finger grip portion adjacent the rear curved end. The lateral slot is narrower than the first aperture and the second aperture. The tether member has a second neck portion connected on a second end of the central shank portion opposite the first neck portion, the second neck portion having a second diameter and being narrower than the central shank portion and having a thickness smaller than the slot in the second clip member. A second end portion is connected to the second neck portion where the second end portion is larger than the slot and the first aperture but smaller than the second aperture, the second clip member being removably connectable to the tether member at the second neck portion.

In still another embodiment of the present invention there is disclosed a method of connecting a clip to a tether member. The method includes providing a first resilient clip member having a curved rear wall portion, an upper and a lower generally rectangular longitudinal finger grip portion diverging forwardly from the curved rear wall portion in opposed relation, a rectangular portion being narrower than the finger grip portion and extending at a forward end thereof in laterally opposed crossed relation, and an upper and a lower L-shaped jaw portion extending from the rectangular portion, each of which is wider than the rectangular portion. Each finger grip portion is sufficiently resilient that when pressed together by the fingers of an operator, the jaw portions will open and when released will be urged toward an abutted condition. The curved rear wall portion has a first aperture with a concave recess at an outer surface, a slot extending from the first aperture to a second aperture located in the upper finger grip portion adjacent the rear curved end. The slot is narrower than the first aperture and the second aperture. The clip also includes a detent connected to the clip member and adjacent to the slot. The method also includes providing a tether member having a central shank portion of a first diameter, a first neck portion on a first end of the central shank portion, the first neck portion having a second diameter and being narrower than the central shank portion and having a thickness smaller than the slot in the first clip member, and a first end portion connected to the first neck portion where the first end portion is larger than the slot and the first aperture but smaller than the second aperture. The method still further includes inserting the first end portion of the tether member through the second aperture and moving the first neck portion of the tether member along the slot to the first aperture and past the detent adjacent the slot where the detent restricts movement of the tether member back to the second aperture.

DETAILED DESCRIPTION OF THE PREFERRED EMBODIMENT

Figure 1:
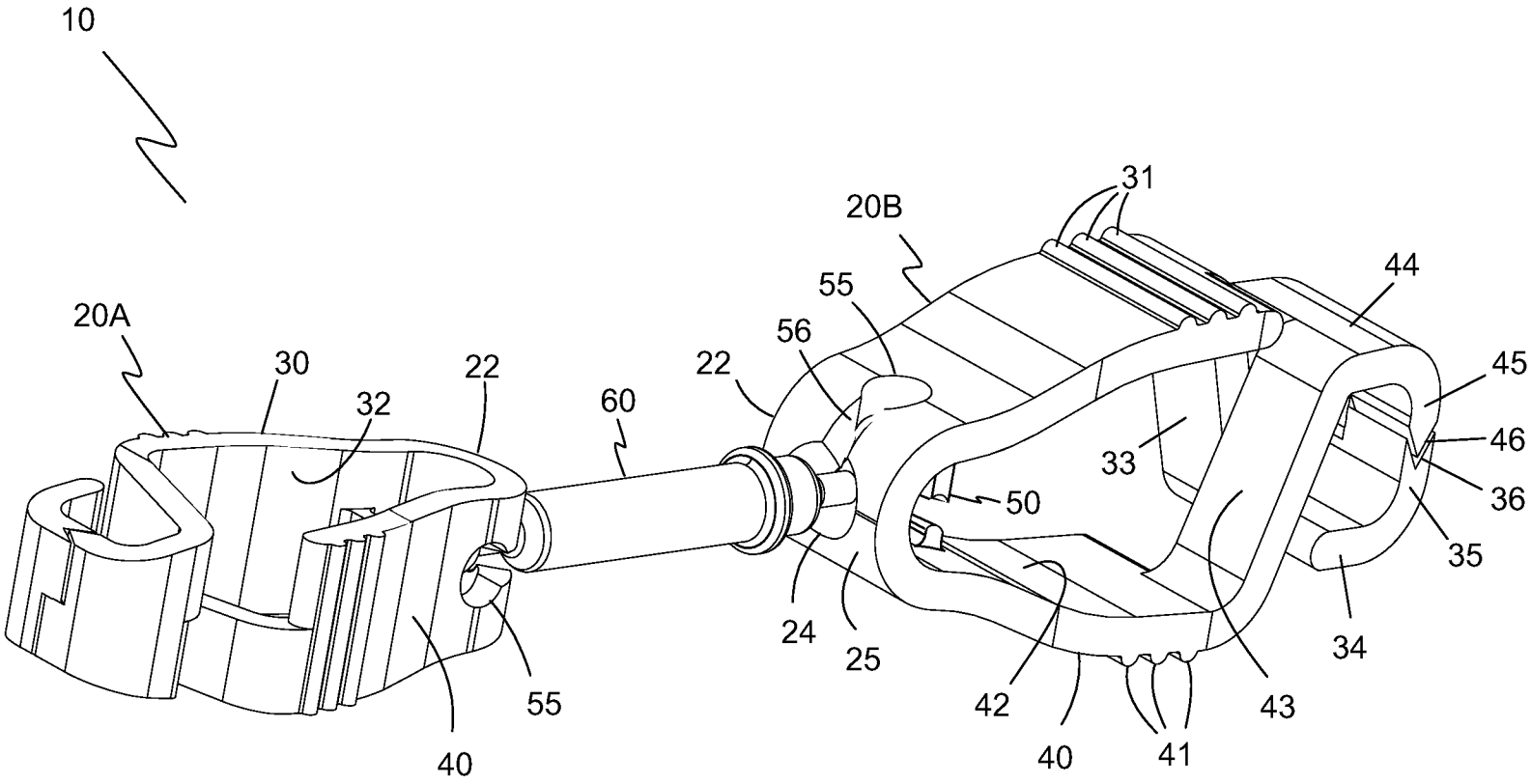
FIG. 1 is a perspective view of one embodiment of the present invention showing a pair of clips with one embodiment of a detent joined to each other by a tether member.
Figure 1A:
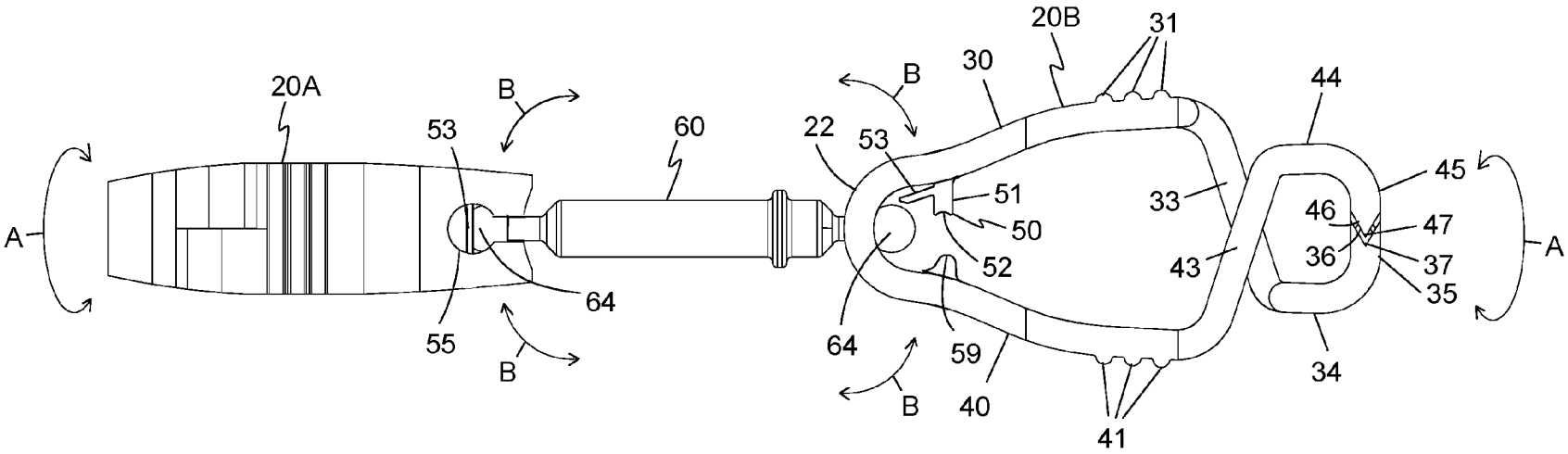
FIG. 1A is a side view of the embodiment shown in FIG. 1

The preferred embodiment(s) of the present invention is illustrated in FIGS. 1-25. FIGS. 1 and 1A show one embodiment of the clip system 10 of the present invention. Clip system 10 includes a first clip member 20A, a second clip member 20B and a tether member 60. First and second clip members 20A and 20B are releasably connected together in opposed relation by tether member 60. Clip members 20A, 20B and tether member 60 are preferably formed of resilient, dielectric material.

First and second clip members 20A and 20B are similar in construction, except that first clip member 20A may be smaller than second clip member 20B. Each of first clip member 20A and second clip member 20B has a generally curved rear wall portion 22 with a first aperture 23, a slot 56 communicating with first aperture 23, and a second aperture 55 communicating with slot 56 (more clearly shown in FIGS. 3 and 5) extending therethrough and a pair of rectangular finger grip portions 30 and 40 diverging forwardly from the rear wall portion 22 in opposed relation in a generally V-shaped configuration as viewed from the side. Optionally, rectangular finger grip portions 30, 40 may be provided with a plurality of transverse ridges 31, 41, respectively, to facilitate gripping by the fingers of the user. Between an inner surface 32 of rectangular finger grip portion 30 and an inner surface 42 of rectangular finger grip portion 40, there is a detent 50. Detent 50 restricts tether member 60 from passing back to second aperture 55 and is more clearly shown and described in FIG. 1A.

Rectangular finger grip portion 30 of each clip has a narrow rectangular portion 33 at one side approximately one-half the width of rectangular portion 30. Narrow rectangular portion 33 extends angularly downward for a distance and widens to form a lower jaw portion 34. Lower jaw portion 34 then extends upwardly to form an upstanding jaw portion 35. Similarly, rectangular finger grip portion 40 of each clip has a narrow rectangular portion 43 at one side approximately one-half the width of rectangular portion 40. Narrow rectangular portion 43 extends angularly upward for a distance and widens to form an upper jaw portion 44. Upper jaw portion 44 then extends downwardly to form a depending jaw portion 45 in opposed relation to jaw portion 35. Lower jaw portion 34 and upwardly extending jaw portion 35 and upper jaw portion 44 and downwardly extending jaw portion 45 form opposed upper and lower, generally, L-shaped jaw portions extending from narrow rectangular portions 33 and 43. Narrow rectangular portions 33, 43 of each clip member 20A, 20B are disposed side by side in opposed angular relation and upstanding and depending jaw portions 35, 45 are abutted together. The diverging rectangular finger grip portions 30, 40 are sufficiently resilient such that when pressed toward each other by the fingers of the operator, jaw portions 35, 45 will open and when released will resume the abutted condition. The abutting surfaces 36, 46 of jaw portions 35, 45 may optionally be provided with a transverse V-shaped grooves 37, 47 and a mating inverted V-shaped edge 38, 48, respectively, to facilitate gripping thin articles.

Turning now to FIG. 1A, there is illustrated a side view of the embodiment shown in FIG. 1. As is more clearly seen, first clip member 20A is connected to second clip member 20B by way of tether member 60. An end portion 64 is releasably received by curved rear wall portion 22 and allows relative rotational movement as illustrated by arrow A as well as relative pivotal movement as illustrated by arrow B between each of clip members 20A and 20B and tether member 60. Detent 50 includes a detent support member 51 and a detent tab 53. Detent support member 51 is spaced a predefined distance forwardly of curved wall portion 22 and extends transversely a predefined distance from inner surface 32 of rectangular finger grip portion 30 terminating in a support member end 52. Detent tab 53 extends transversely a predefined distance from detent support member 51 towards curved rear wall portion 22 adjacent to and aligned with second aperture 55. Detent tab 53 is made of a resilient, bendable material that allows tether member 60 to ingress through second aperture 55 by engaging first end portion 64 of tether member 60 and disengaging first end portion 64 as first end portion 64 advances past detent tab 53 along slot 56 to first aperture 23 while restricting egress of tether member 60 back to second aperture 55, which egress cannot be achieved without user intervention. The user may separate tether member 60 from clip member 20A and/or 20B by using a push rod device (not shown) to bend detent tab 53 sufficiently to allow tether member 60 to pass back to second aperture 55. Opposite detent support member 51 is an optional support member interface 59 extending transversely from inner surface 42 of rectangular finger grip portion 40. Optional support member interface 59 is positioned to engage support member end 52 to prevent over stressing curved rear wall portion 22 when clip member 20A and/or 20B are squeezed to open the jaw portions 34 and 35. It is contemplated that support member 51 may optionally be extended so that support member end 52 engages inner surface 42 of finger grip portion 40 when clip member 20A and/or 20B is squeezed, obviating the need for support member interface 59.

Figure 2:
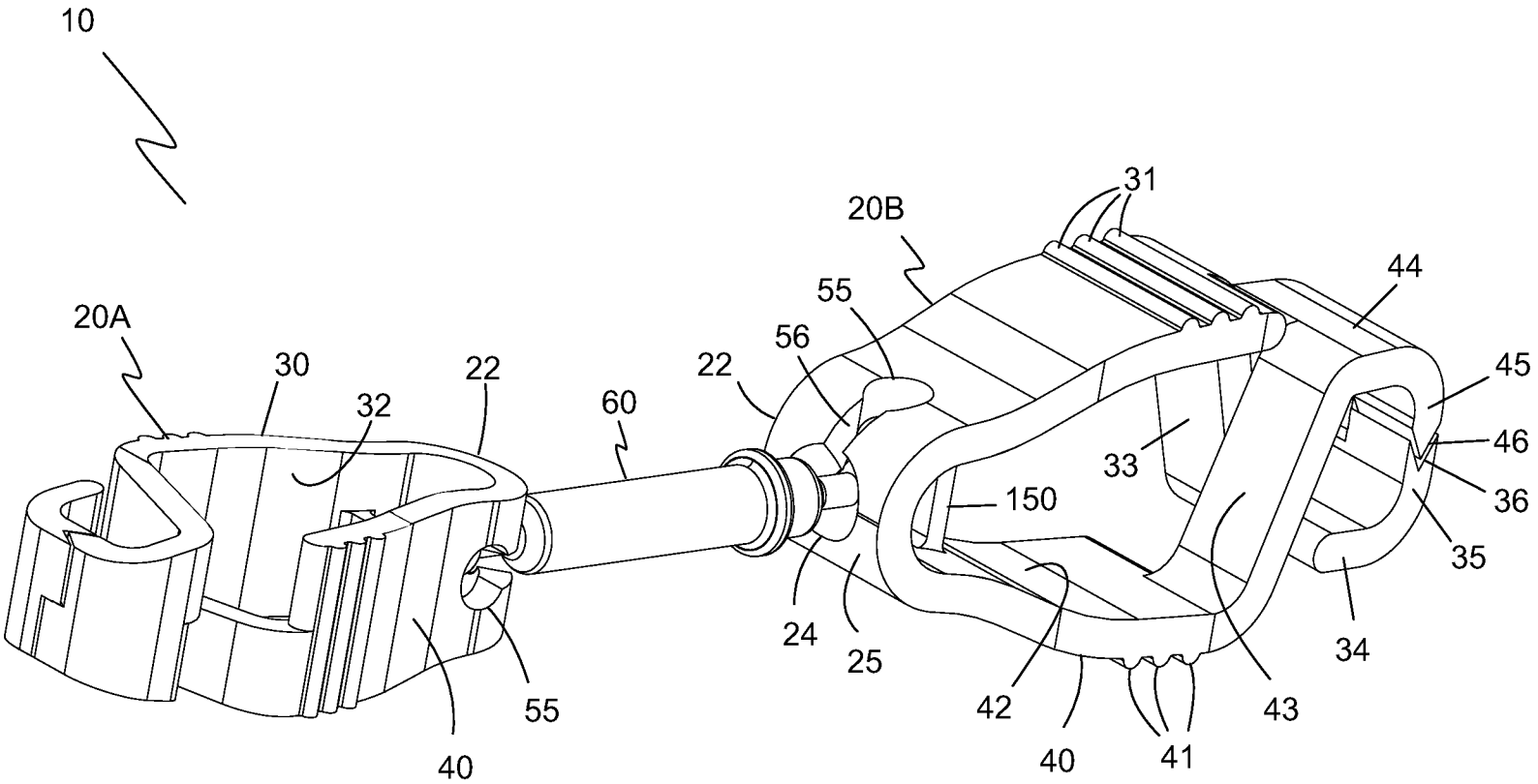
FIG. 2 is a perspective view of another embodiment of the present invention showing a pair of clips with another embodiment of a detent joined to each other by a tether member.

FIG. 2 shows another embodiment of the clip system 10 of the present invention. As in FIG. 1, clip system 10 illustrated in FIG. 2 includes a first clip member 20A, a second clip member 20B and a tether member 60. First and second clip members 20A and 20B are releasably connected together in opposed relation by tether member 60. Clip members 20A, 20B and tether member 60 are preferably formed of resilient, dielectric material.

First and second clip members 20A and 20B are similar in construction, except that first clip member 20A may be smaller than second clip member 20B. Each of first clip member 20A and second clip member 20B has a generally curved rear wall portion 22 with a first aperture 23, a slot 56 communicating with first aperture 23, and a second aperture 55 communicating with slot 56 (shown in FIGS. 3 and 5) extending therethrough and a pair of rectangular finger gripping portions 30 and 40 diverging forwardly from the rear wall portion 22 in opposed relation in a generally V-shaped configuration as viewed from the side. Optionally, rectangular finger grip portions 30, 40 may be provided with a plurality of transverse ridges 31, 41, respectively, to facilitate gripping by the fingers of the user. Between an inner surface 32 of rectangular finger grip portion 30 and an inner surface 42 of rectangular finger grip portion 40, there is a narrow rectangular web portion 150 spaced a short distance forwardly of curved rear wall portion 22. A detent 50 is provided in this embodiment and is more clearly shown in FIGS. 3-5 and described therewith.

Rectangular finger grip portion 30 of each clip has a narrow rectangular portion 33 at one side approximately one-half the width of rectangular portion 30. Narrow rectangular portion 33 extends angularly downward for a distance and widens to form a lower jaw portion 34. Lower jaw portion 34 then extends upwardly to form an upstanding jaw portion 35. Similarly, rectangular finger grip portion 40 of each clip has a narrow rectangular portion 43 at one side approximately one-half the width of rectangular portion 40. Narrow rectangular portion 43 extends angularly upward for a distance and widens to form an upper jaw portion 44. Upper jaw portion 44 then extends downwardly to form a depending jaw portion 45 in opposed relation to jaw portion 35. Lower jaw portion 34 and upwardly extending jaw portion 35 and upper jaw portion 44 and downwardly extending jaw portion 45 form opposed upper and lower, generally, L-shaped jaw portions extending from narrow rectangular portions 33 and 43. Narrow rectangular portions 33, 43 of each clip member 20A, 20B are disposed side by side in opposed angular relation and upstanding and depending jaw portions 35, 45 are abutted together. The abutting surfaces 36, 46 of jaw portions 35, 45 may optionally be provided with a transverse V-shaped grooves 37, 47 and a mating inverted V-shaped edge 38, 48, respectively, to facilitate gripping thin articles.

Figure 2A:
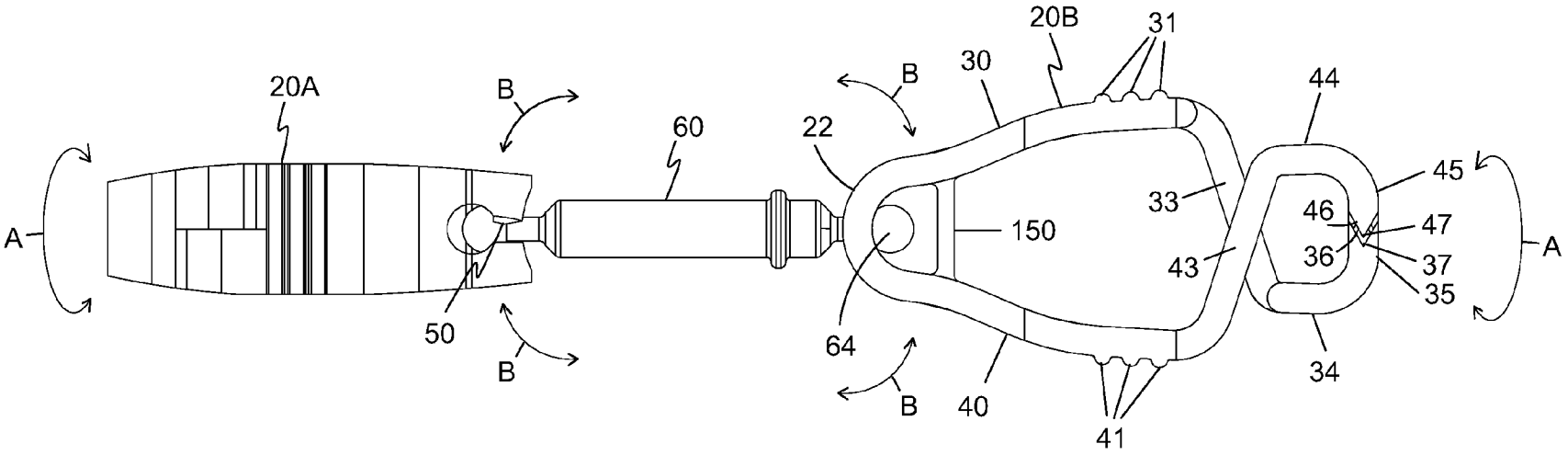
FIG. 2A is side view of the embodiment shown in FIG. 2.

Turning now to FIG. 2A, there is illustrated a side view of the embodiment shown in FIG. 2. As is more clearly seen, first clip member 20A is connected to second clip member 20B by way of tether member 60. An end portion 64 is releasably received by curved rear wall portion 22 and allows relative rotational movement as illustrated by arrow A as well as relative pivotal movement as illustrated by arrow B between each of clip members 20A and 20B and tether member 60.

Figures 3, 4, 5:
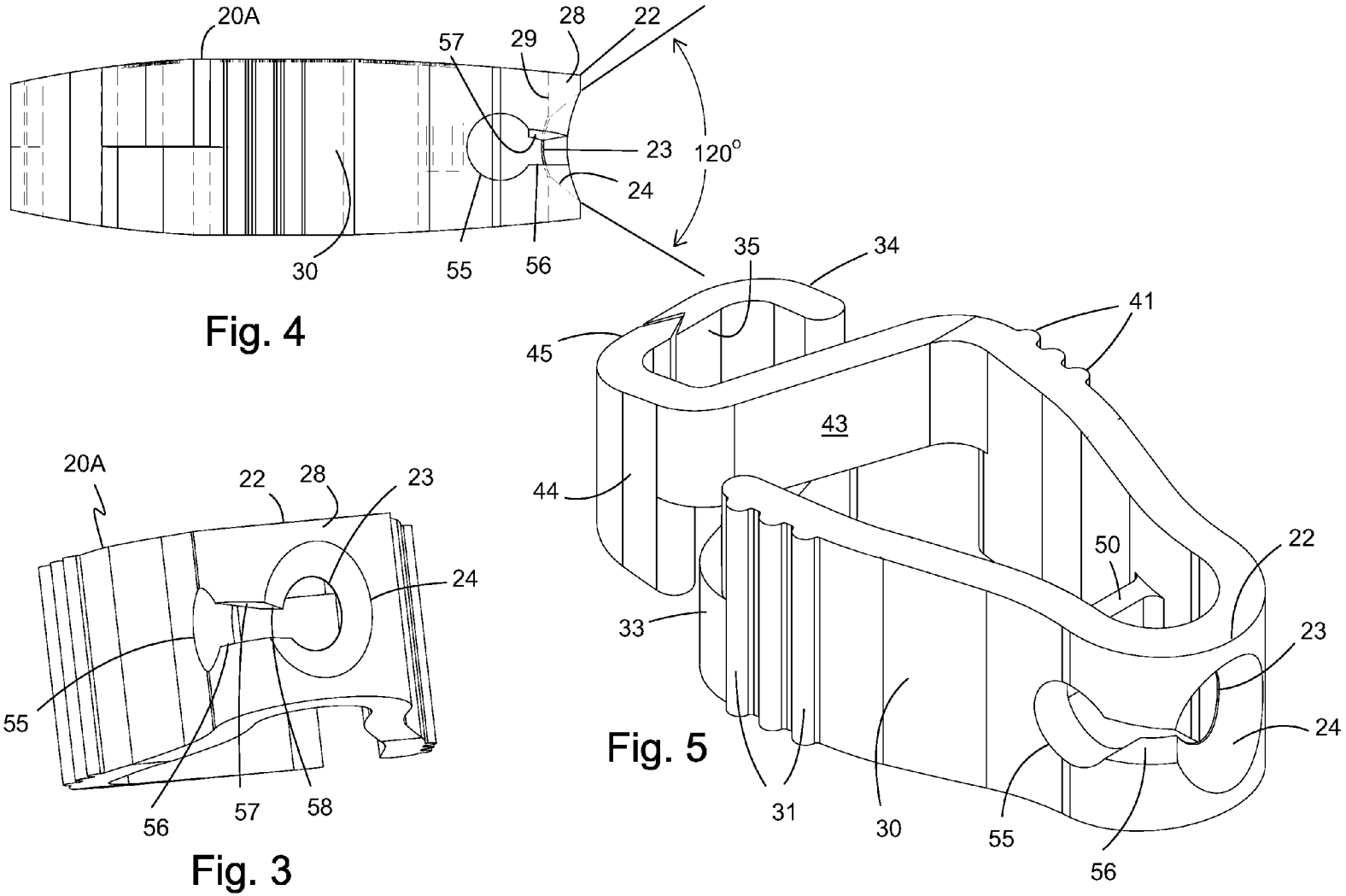
FIG. 3 is a rear perspective view of the embodiment of the clip member of the present invention illustrated in FIGS. 2 and 2A showing the rear curved end.
FIG. 4 is a side view of the embodiment shown in FIG. 3.
FIG. 5 is a perspective view of the embodiment shown in FIG. 3.

FIG. 3 illustrates a rear perspective view of first clip member 20A showing curved rear wall portion 22. Rear wall portion 22 has first aperture 23 extending therethrough. Rear wall portion 22 also includes an optional concave recess 24 in an outer surface 28 of rear wall portion 22. Concave recess 24 is axially aligned with aperture 23. In one embodiment, concave recess 24 defines a second aperture 55 extends through rectangular portion 30 adjacent rear wall portion 22. A slot 56 extends between second aperture 55 and first aperture 23 such that second aperture 55 communicates with first aperture 23. Slot 56 has a width that is narrower than the first and second apertures 23, 55, respectively. Slot 56 also optionally includes a detent 50 in the form of a slot wall 57 that tapers from second aperture 55 to first aperture 23 and from outer surface 28 of rear wall portion 22 to an inner surface 29 of rear wall portion 22 forming a lip 58. Once tether member 60 is joined to rear wall portion of clip members 20A and 20B through slot 56, lip 58 (i.e. detent 50) restricts tether member 60 from inadvertently re-entering slot 56. FIG. 4 is a side view of first clip member 20A that more clearly shows lip 58, slot wall 57 and inside surface 29 of rear wall portion 22. Concave recess 24 has a wall that defines an angle (i.e. a recess angle) between the surfaces of concave recess 24. As shown in FIG. 2A by arrows A and B, the wall of concave recess 24 is such that an article extending through first aperture 23 is capable of pivoting and rotating within the frustum. The angle is less than 180 degrees and greater than 0 degrees. Preferably, the angle is in a range of about 45 degrees to about 150 degrees and, more preferably, in a range of about 90 degrees to about 130 degrees. The most preferred angle is 120 degrees and is illustrated in FIG. 4.

FIG. 5 is a perspective view of first clip member 20A showing the relationship of the various structural components of first clip member 20A. As previously disclosed first clip member 20A and second clip member 20B are similar in construction. The clip members 20A, 20B each have rectangular finger grip portions 30, 40 that have narrow rectangular portions 33, 43 at one side approximately one-half the width of corresponding rectangular portions 30, 40. Narrow rectangular portions 33, 43 extend angularly toward opposing rectangular portions 30, 40 for a distance and then widen to form jaw portions 34, 44. Jaw portions 34, 44 extend for a distance before turning towards each other where extending jaw portions 35, 45 are abutted together. The abutting surfaces 36, 46 of jaw portions 35, 45 may optionally be provided with mating surfaces 36, 46 having a shape that facilitates gripping thin articles.

Figure 6:
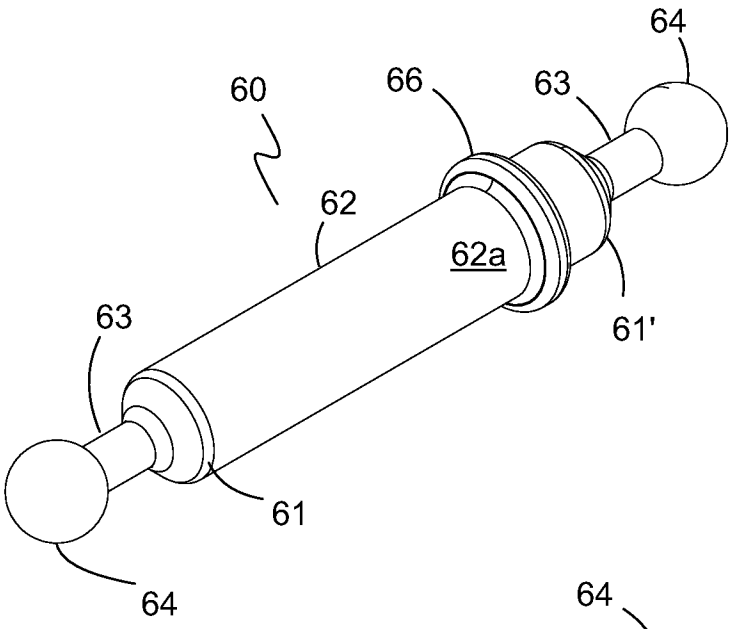
FIG. 6 is a perspective view of one embodiment of the tether member showing the central portion and the end portions.

FIG. 6 is a perspective view of one embodiment of tether member 60. Tether member 60 has a central shank portion 62 of a first diameter and a neck portion 63 on opposite ends 61, 61' of central shank portion 62. Each neck portion 63 has a second diameter that is narrower than central shank portion 62 and has a thickness smaller than slot 56 in first and second clip members 20A, 20B except when detent 50 is lip 58 where slot 56 at lip 58 is slightly smaller than neck portion 63, and an end portion 64 connected at opposite ends to neck portion 63 of central shank portion 62. End portion 64 is larger than slot 56 and first aperture 23 to restrict tether member 60 from being inadvertently pulled transversely therethrough but smaller than second aperture 55 to allow mating of tether member 60 to clip members 20A, 20B. The shape of tether member 60 provides the structure that allows rotational movement to clip members 20A, 20B. End portion 64 is disposed adjacent an inward side 29 of rear wall portion 22 to rotatably retain clip member 20A on tether member 60. When attached to both clip members 20A, 20B, tether member 60 maintains clip members 20A, 20B in axially opposed relation and allows relative rotational movement between clip members 20A, 20B and tether member 60. In this embodiment, there is shown an optional stop 66 that extends from an outer surface 62*a* of central shank portion 62 a predefined distance. Although optional stop 66 is shown as extending around the circumference of central shank portion 62, it may extend only from a portion of outer surface 62*a* or be a plurality of ridge stops spaced from each other but circumferentially aligned with each other or it may be a groove (not shown) for receiving a mating ridge component incorporated in an openable container described below.

Figure 7:
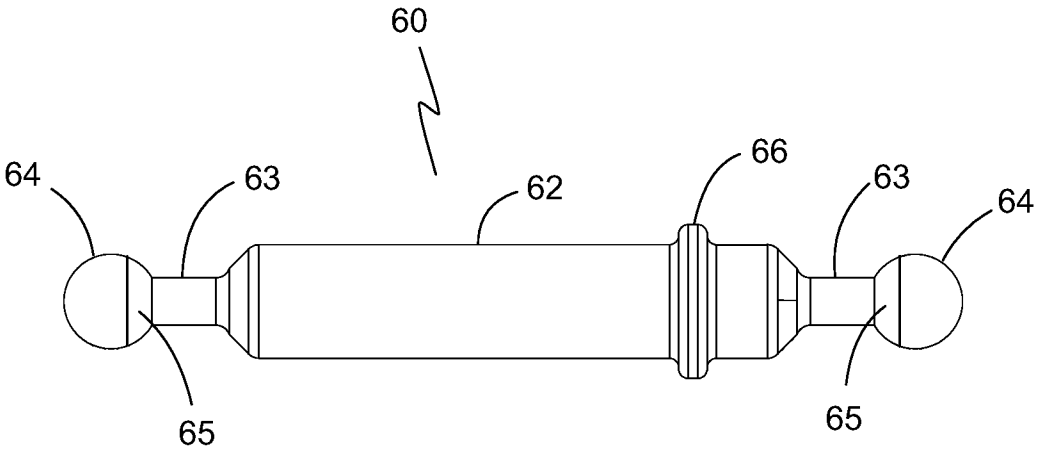
FIG. 7 is a side view of the embodiment shown in FIG. 6.

FIG. 7 is a side view of the embodiment of tether member 60 shown in FIG. 6. End portions 64 have an end portion surface 65 adjacent neck portion 63 that is a curved surface or cone-shaped surface or an angularly-shaped surface. End portion surface 65 provides, in cooperation with recess 24 of rear wall portion 22, to allow relative pivotal and rotational movement between clip members 20A, 20B and tether member 60. It is noted that tether member 60 may have any usable length and shape depending on the intended use of the clip member assembly. For instance, FIGS. 19-22 are illustrative examples of alternative configurations but it should be understood that these illustrative examples are non-limiting.

Each clip member 20A and 20B is releasably attached to tether member 60 by inserting tether end 64 through second opening 55 until neck portion 63 is aligned with slot 56 and sliding neck portion 63 toward first opening 23 and recess 24 until it passes into first opening 23. Once neck portion 63 passes into first opening 23, lip 58 of detent 50 restricts the inadvertent movement of neck portion 63 back to second opening 55 where tether member 60 could be inadvertently disconnected from clip member 20A, 20B. In the assembled condition, clip members 20A and 20B and tether member 60 rotate and pivot relative to each other.

Under most conditions, clip members 20A and 20B are prevented from being pulled off tether member 60 by inside surface 29 of rear wall portion 22 engaging the curved or angled surface 65 of tether end 64.

Figure 8:
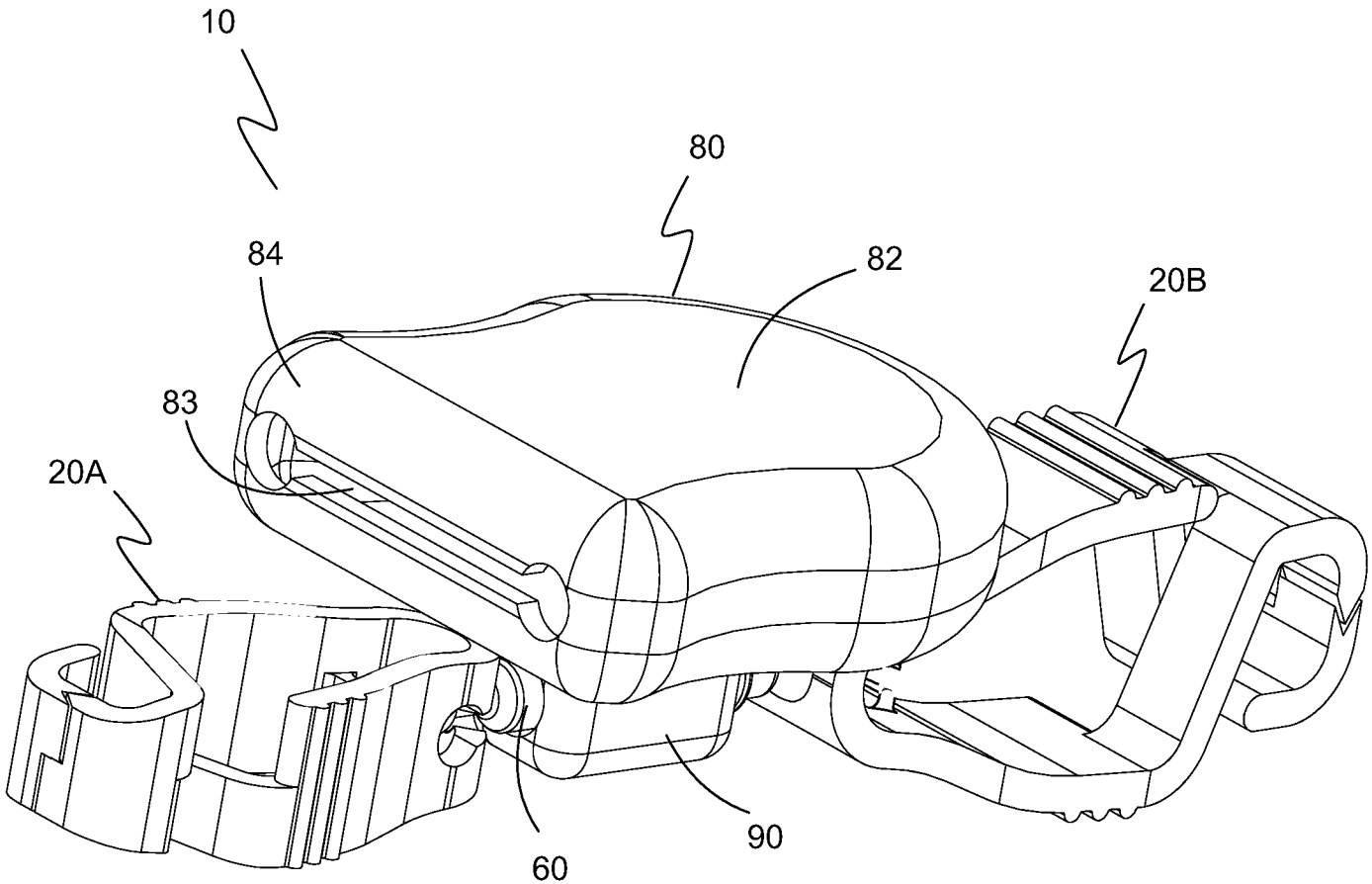
FIG. 8 is a perspective view of another embodiment of the present invention showing a pair of clips joined to each other by a tether member and a pouch.

Turning now to FIG. 8, there is illustrated another embodiment of the present invention. In this embodiment, clip system 10 not only includes first clip member 20A, second clip member 20B and tether member 60 but also an openable container 80. Openable container 80 is an enclosure or housing for receiving and holding small items such as, for example, ear plugs. In this embodiment, openable container 80 is a pouch having a housing portion 82 and a connector portion 90 that connects to and is held by tether member 60. In this embodiment, connector portion 90 has a longitudinal through opening 92 into which central shank portion 62 of tether member 60 is received. Housing portion 82 has a container entrance 83 in a housing first end 84 that provides access to the inside of housing 82.

Figure 9:
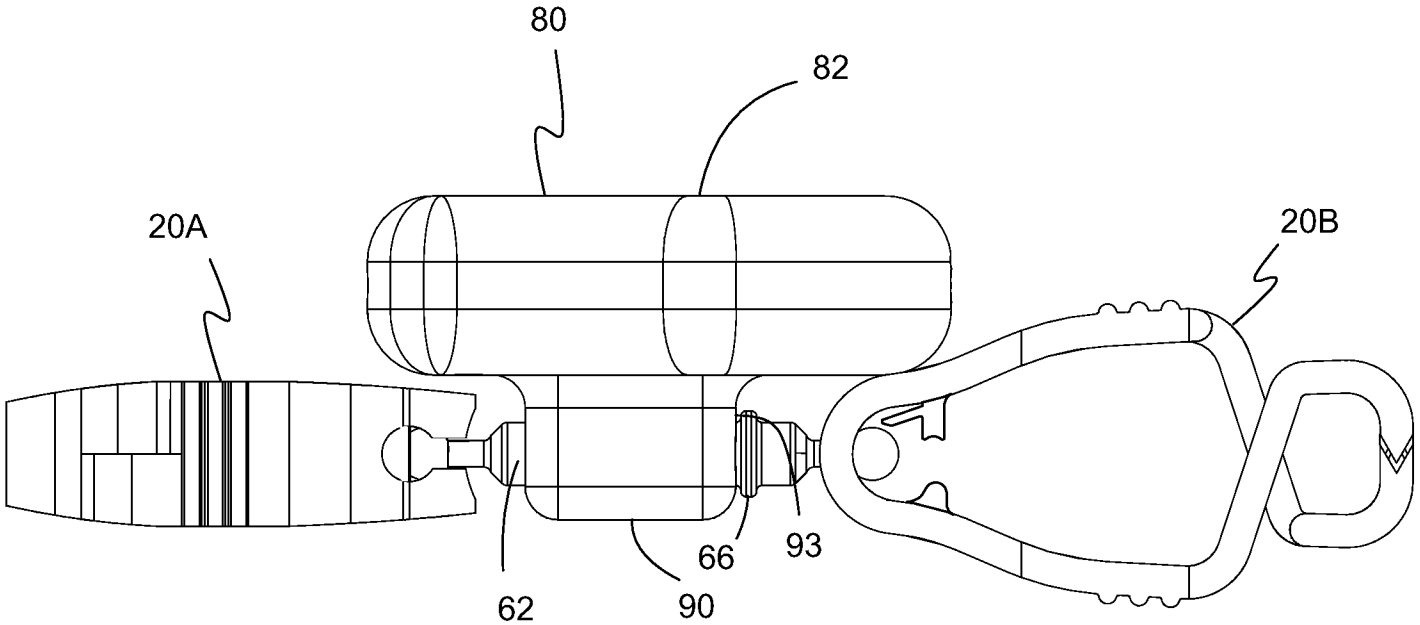
FIG. 9 is a side view of the embodiment shown in FIG. 8.

FIG. 9 is a side view of the embodiment in FIG. 8. As can be seen in FIG. 9, connector portion 90 is attached to central shank portion 62 of tether member 60. In this embodiment, central shank portion 62 has optional stop 66 which acts to prevent pouch 80 from moving past stop 66. Typically, first clip member 20A attaches to a belt, belt loop, and the like where clip system 10 would hang substantially vertical and pouch 80 would have container entrance 83 and housing first end 84 oriented as the top of pouch 80 and optional stop 66 would support an end 93 of connector portion 90.

Figure 11:
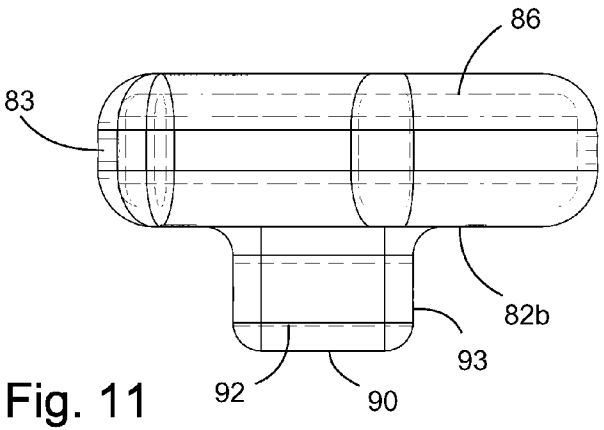
FIG. 11 is a side view of the embodiment of the openable container shown in FIG. 10.
Figure 12:
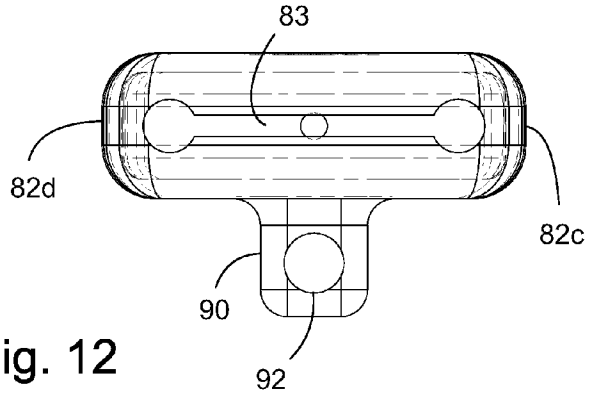
FIG. 12 is an end view of the embodiment of the openable container shown in FIG. 10 showing the pouch entrance.
Figure 10:
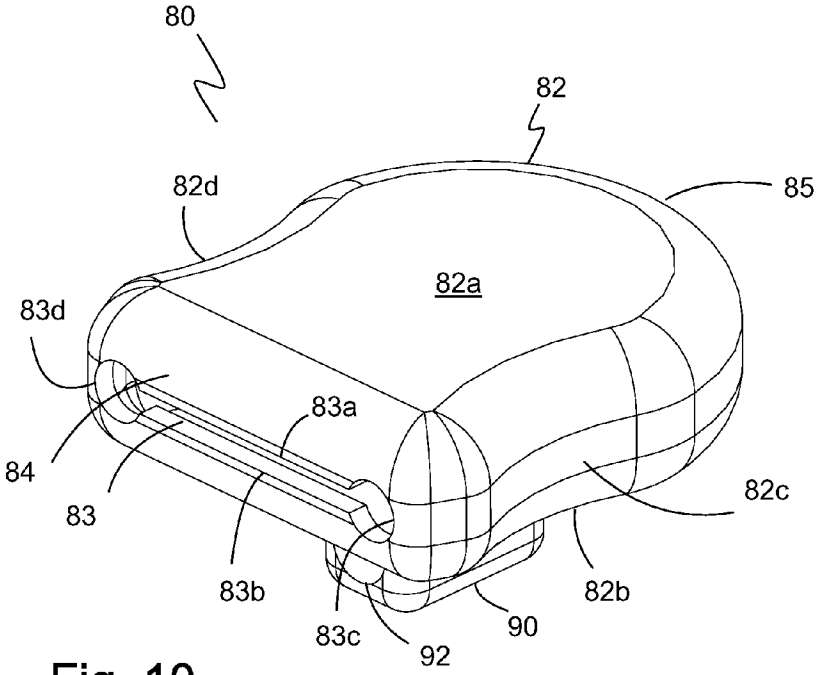
FIG. 10 is a perspective view of one embodiment of an openable container showing a pouch with a pouch entrance on an end of the pouch.

FIGS. 10-13 illustrate the embodiment of openable container or pouch 80 shown in FIG. 8. Pouch 80 includes housing portion 82 that has a top surface 82*a*, a bottom surface 82*b*, a first side 82*c*, a second side 82*d*, housing first end 84, and a housing second end 85. First housing end 84 incorporates container entrance 83 having entrance sides 83*a*, 83*b* and entrance ends 83*c*, 83*d*. Pouch 80 also includes connector portion 90 that is connected to bottom surface 82*b* of housing portion 82. In this embodiment of pouch 80, it is preferred that pouch 80 is made of a resilient, semi-flexible material so that when first side 82*c* and second side 82*d* are squeezed towards each other, the entrance ends 83*c*, 83*d* of container entrance 83 are also spatially forced toward each other causing the sides 83*a*, 83*b* of container entrance 83 to bulge away from each other making container entrance 83 wider and forming a substantially elliptically-shaped opening through which access to the inside of housing 82 is more easily attained for adding or removing items from pouch 80. FIG. 11 is a side view of pouch 80 showing housing portion 82 defining an inside volume 86 that communicates with container entrance 83. Connector portion 90 connects to bottom surface 82*b* and is typically integrally formed when pouch 80 is molded. Connector portion 90 includes a longitudinal through opening 92 that is more clearly shown in FIG. 12.

Figure 13:
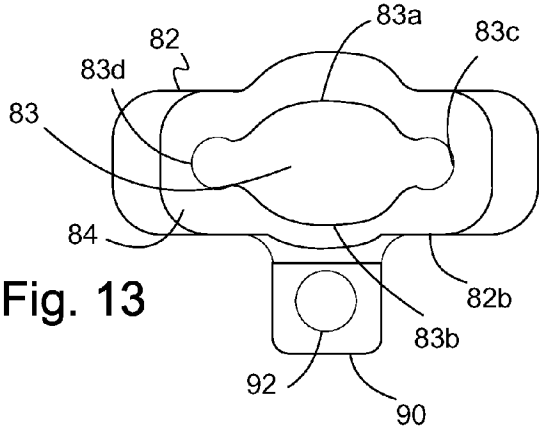
FIG. 13 is an end view of the embodiment of the pouch shown in FIG. 10 showing the pouch entrance in a squeezed condition.

FIG. 13 is a graphical illustration of container entrance 83 when a user squeezes housing sides 82*c*, 82*d*. As can be seen, container entrance 83 takes on a generally elliptical shape that provides a larger opening for access to inside volume 86. Because of the resilient characteristic of the material, when the squeezing force is removed from housing sides 82*c*, 82*d*, container entrance 83 returns to its orientation shown in FIGS. 10 and 12 prior to the squeezing action, which effectively prevents the items placed within inside volume 86 for storage from passing through opening 83.

Figure 15:
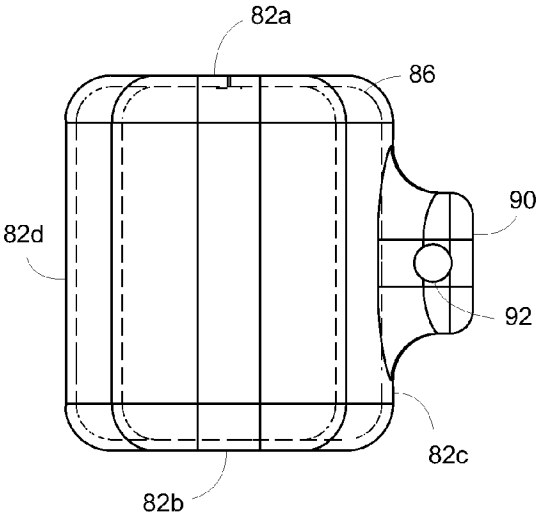
FIG. 15 is a side view of the embodiment of the openable container shown in FIG. 14.
Figure 14:
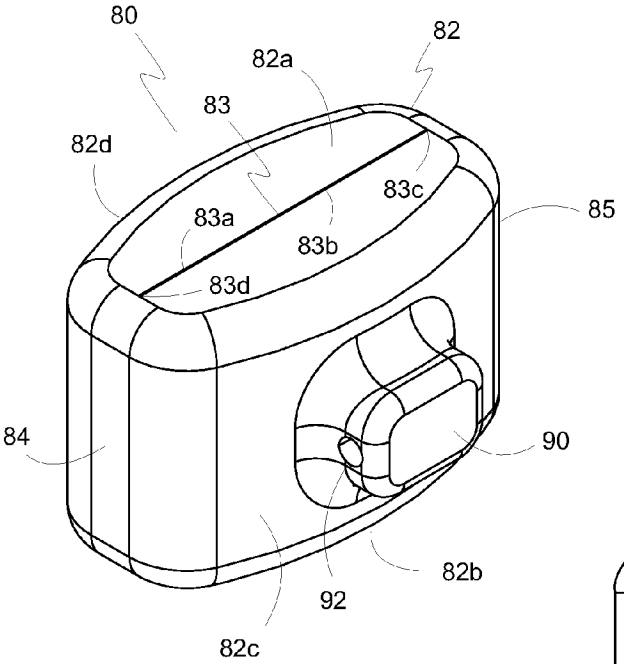
FIG. 14 is a perspective view of another embodiment of the openable container showing a pouch with a pouch entrance on the side of the pouch.

Turning now to FIG. 14, there is illustrated another embodiment of openable container or pouch 80. Pouch 80 includes housing portion 82 that has a top surface 82*a*, a bottom surface 82*b*, a first side 82*c*, a second side 82*d*, housing first end 84, and a housing second end 85. Top surface 82*a* incorporates container entrance 83. Container entrance in this embodiment is a slit with longitudinal sides 83*a*, 83*b* that extend completely through top surface 82*a* to the inside of pouch 80. Pouch 80 also includes connector portion 90 that is connected to bottom surface 82*b* of housing portion 82. In this embodiment of pouch 80, it is preferred that pouch 80 is also made of a resilient, semi-flexible material so that when first housing end 84 and second housing end 85 are squeezed towards each other, the entrance ends 83*c*, 83*d* of container entrance 83 are also spatially forced toward each other causing the longitudinal sides 83*a*, 83*b* of slit 83 of container entrance 83 to bulge away from each other making opening 83 wider and forming a substantially elliptically-shaped opening through which access to the inside of housing 82 is more easily attained for adding or removing items from pouch 80. FIG. 15 is a side view of pouch 80 showing housing portion 82 defining an inside volume 86 that communicates with container entrance 83. Connector portion 90 connects to bottom surface 82*b* and is typically integrally formed when pouch 80 is molded. Connector portion 90 includes a longitudinal through opening 92.

Figure 16:
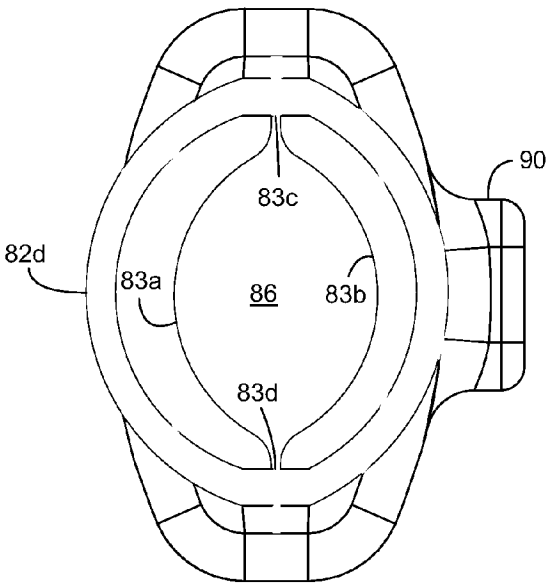
FIG. 16 is a side view of the embodiment of the openable container shown in FIG. 14 showing the pouch entrance.

FIG. 16 is a graphical illustration of opening 83 when a user squeezes first and second housing ends 84, 85. As can be seen, opening 83 takes on a generally elliptical shape that provides a larger opening for access to inside volume 86. Because of the resilient characteristic of the material, when the squeezing force is removed from first and second housing ends 84, 85, container entrance 83 returns to its orientation shown in FIG. 14 prior to the squeezing action, which effectively prevents the items placed within inside volume 86 for storage from passing through container entrance 83.

Figure 17:
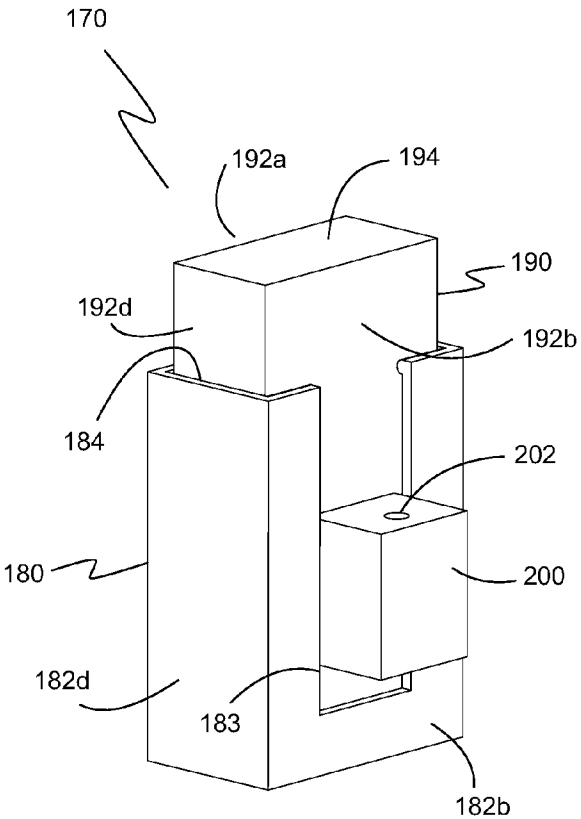
FIG. 17 is a perspective view of another embodiment of the openable container showing a rectangularly-shaped outer sleeve and a rectangularly-shaped inner housing in a closed position.

FIG. 17 illustrates another embodiment of an openable container 170. Openable container 170 includes an outer sleeve 182 and an inner housing 190 that is received within outer sleeve 182. Inner housing 190 and outer sleeve 180 are shown in a closed, first position. Inner housing 190 includes a first end wall 194 and a second end wall 195 (not shown) and a plurality of side walls 192*a*, 192*b*, 192*c*, and 192*d* between first and second end walls 194, 195 forming a rectangularly-shaped enclosure. Inner housing 190 has connector portion 200 that is connected to bottom surface 192*b*. Outer sleeve 180 includes a plurality of side walls 182*a*, 182*b*, 182*c*, and 182*d* with an open end 184 for receiving inner housing 190. Side wall 182*b* has a slot 183 that extends from open end 184 along a major portion of side wall 182*b* and having a width to accommodate movement of connector portion 200 along and within slot 183.

Figure 18:
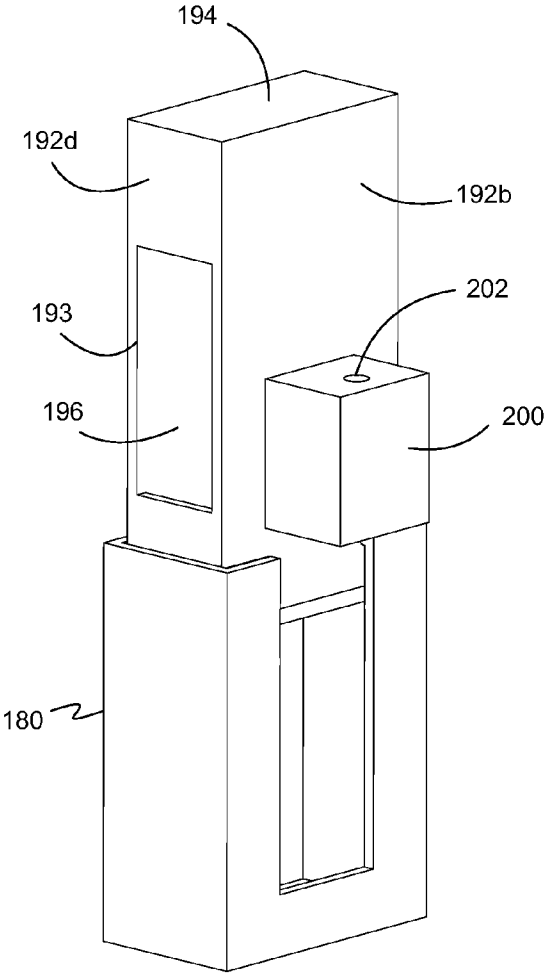
FIG. 18 is a perspective view of the embodiment of the openable container in FIG. 17 showing the rectangularly-shaped outer sleeve and the rectangularly-shaped inner housing in an open position.

FIG. 18 is a perspective view of the embodiment of openable container 170 in an open, second position. In this illustration, there is shown inner housing 190 defining an inside volume 196 and a container entrance 193 in side wall 192*d* that communicates with inside volume 196. It should be noted that container entrance 193 may optionally be located in any of side walls 192*a*, 192*c*, or 192*d* where side walls 182*a*, 182*c*, or 182*d*, respectively, block container entrance 193 when inner housing 190 and outer sleeve 180 are in a closed position preventing the contents within inside volume 196 from being removed purposely or inadvertently.

Figure 19:
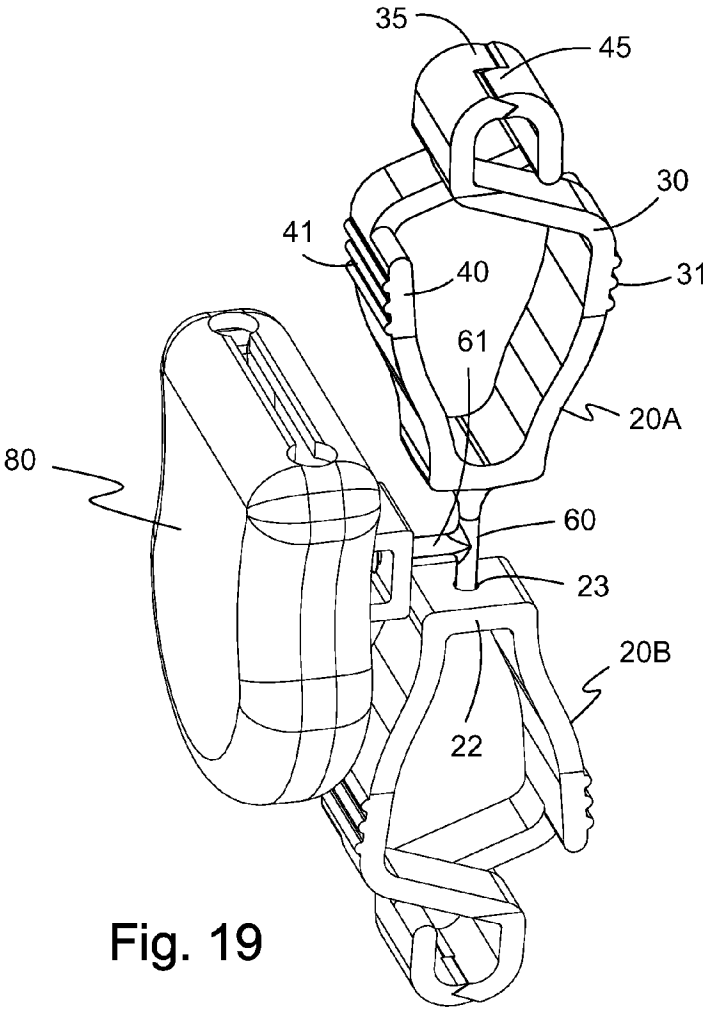
FIG. 19 is a perspective view of another embodiment of a clip system and openable container combination showing a T-shaped tether member.

FIG. 19 illustrates another embodiment of the combination of a clip system and openable container. In this embodiment, clip system 10 includes a first clip member 20A, a second clip member 20B, a tether member 60, and an openable container 80. First and second clip members 20A and 20B are releasably connected together in opposed, axial relation by tether member 60. Clip members 20A, 20B and tether member 60 are preferably formed of resilient, dielectric material. Tether member 60 in this embodiment is T-shaped having a transverse portion 61 connected to and supporting openable container 80.

First and second clip members 20A and 20B are similar in construction, except that first clip member 20A may be smaller than second clip member 20B and one end of tether member 60 may be an integral part of first clip member 20A. Each of first clip member 20A and second clip member 20B has a generally curved or flat rear wall portion 22 with a first aperture 23 extending therethrough and a pair of rectangular finger gripping portions 30 and 40 diverging forwardly from the rear wall portion 22 in opposed relation in a generally V-shaped configuration. Optionally, rectangular finger grip portions 30, 40 may be provided with a plurality of transverse ridges 31, 41, respectively, to facilitate gripping by the fingers of the user.

Rectangular finger grip portions 30, 40 of each clip has a structure as previously described defining a pair of opposed, openable jaw portions 35, 45. Openable container 80, likewise, has a structure similar to that previously described except that the tether member 60 in this embodiment is T-shaped having a transverse portion 61.

Figure 20:
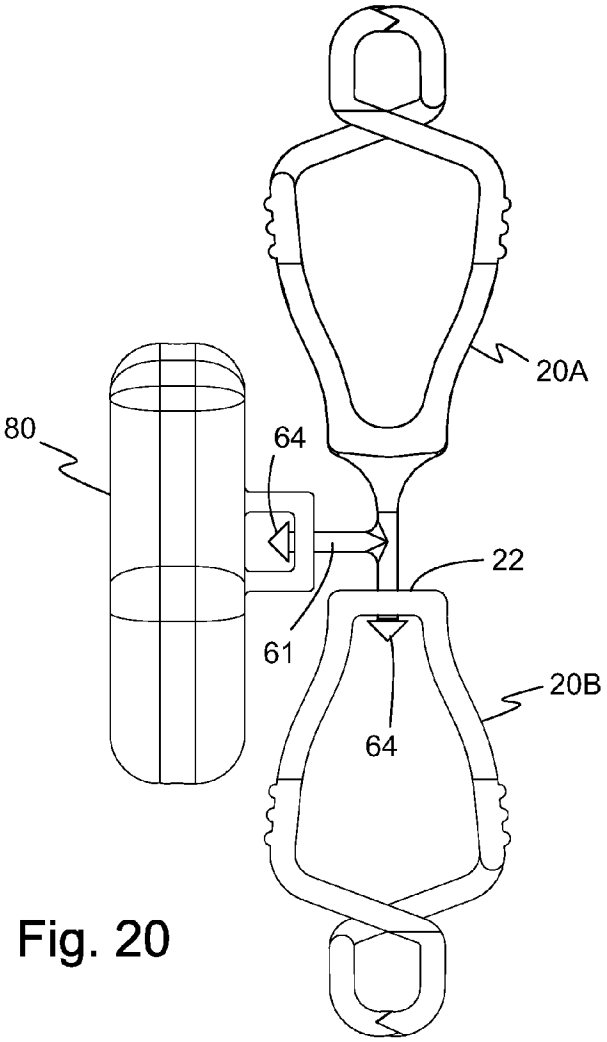
FIG. 20 is a side view of the embodiment shown in FIG. 19.

Turning now to FIG. 20, there is illustrated a side view of the embodiment shown in FIG. 19. As is more clearly seen, first clip member 20A is connected to second clip member 20B by way of tether member 60. An end portion 64 is releasably received by rear wall portion 22 and allows relative rotational movement and optional relative pivotal movement between clip member 20B and tether member 60. Transverse portion 61 also has an end portion 64 that is larger than the diameter of transverse portion 61. End portion 64 is forcibly received into a transverse opening 92 of connector portion 90 on openable container 80. End portion 64 is sufficiently larger than the diameter of transverse opening 92 to require force to insert tether member 60 thereto and remove tether member 60 therefrom.

Figure 22:
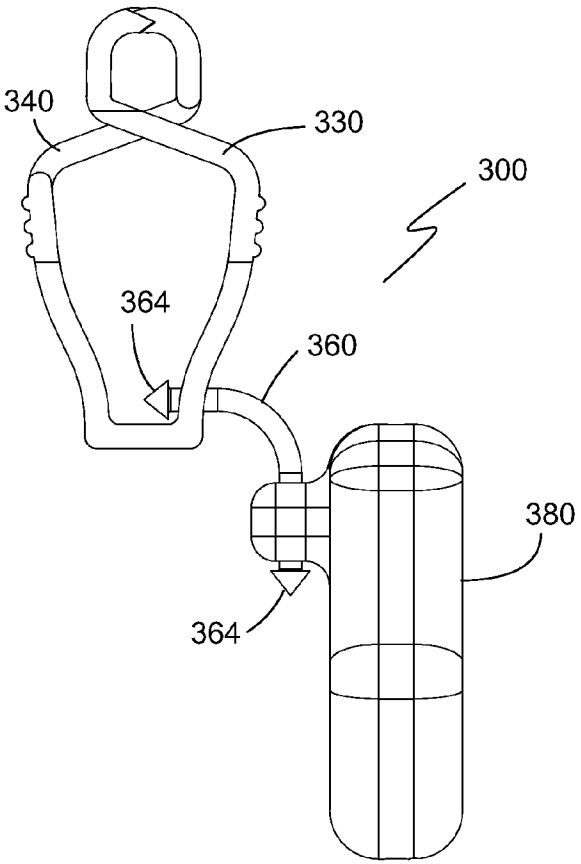
FIG. 22 is a side view of the embodiment shown in FIG. 21.
Figure 21:
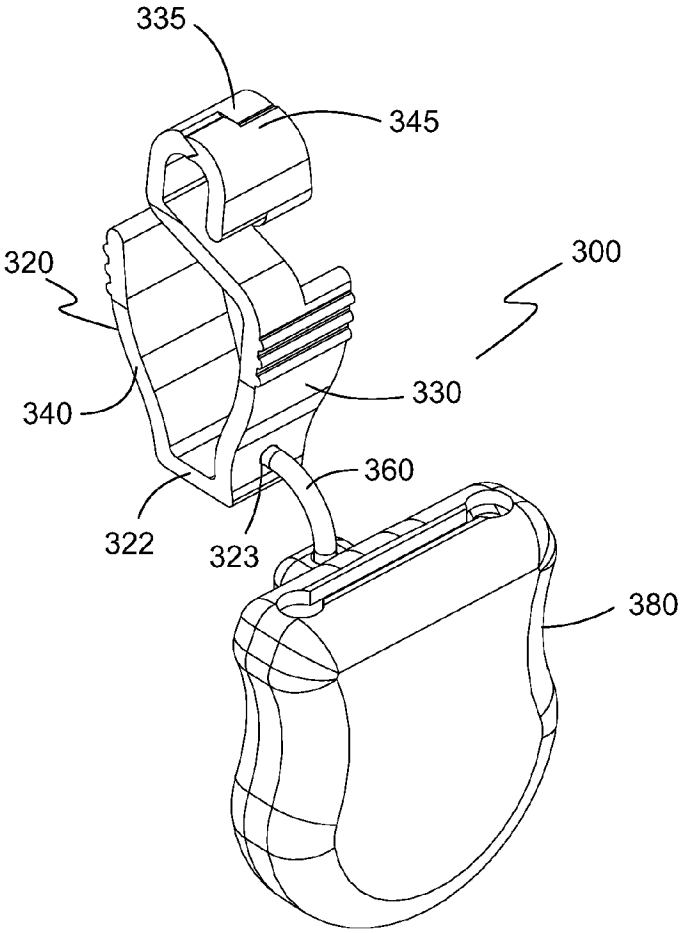
FIG. 21 is a perspective view of another embodiment of a clip and openable container combination showing a curved tether member connected to the clip through an opening in the side of the clip.

FIGS. 21 and 22 illustrate another embodiment of a clip and openable container combination 300. In this embodiment, Combination 300 includes a clip member 320, a tether member 360 and an openable container 380. Clip member 320 and openable container 380 are releasably connected together by tether member 360 where tether end portion 64 is larger than the respective connector openings that receive tether member 60. Clip member 320 and tether member 360 are preferably formed of resilient, dielectric material. Tether member 360 in this embodiment is L-shaped or curved having end portions 64 transverse to each other. First clip member 320 has a generally curved or flat rear wall portion 322 and a pair of rectangular finger grip portions 330 and 340 diverging forwardly from the rear wall portion 322 in opposed relation in a generally V-shaped configuration. One of finger grip portions 330 and 340 has a first aperture 323 extending therethrough. Optionally, rectangular finger grip portions 330, 340 may be provided with a plurality of transverse ridges 331, 341, respectively, to facilitate gripping by the fingers of the user.

Rectangular finger grip portions 330, 340 of each clip has a structure as previously described defining a pair of opposed, openable jaws 335, 345. Openable container 380, likewise, has a structure similar to that previously described.

Figure 23:
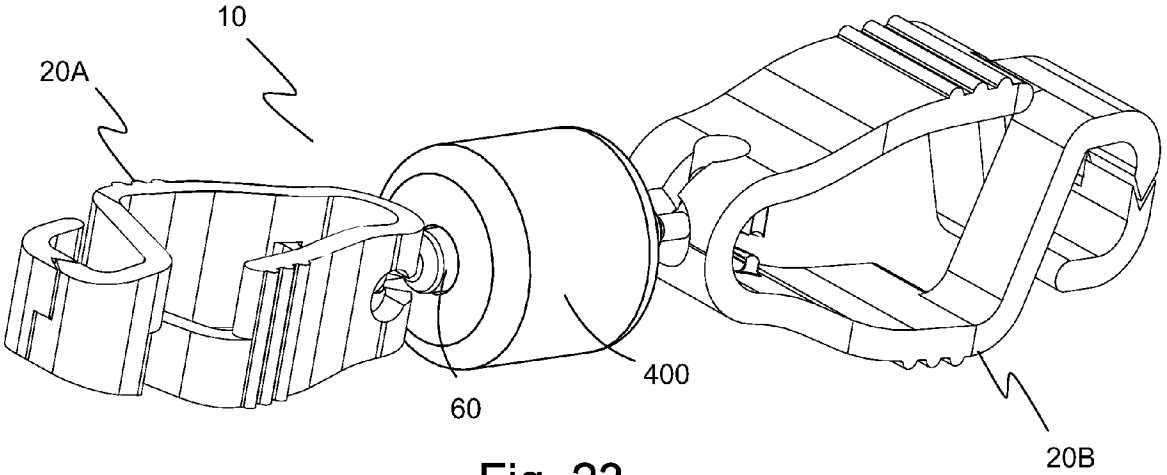
FIG. 23 is a perspective view of another embodiment of the present invention showing a pair of clips joined to each other by a tether member and a floatation component.
Figure 25:
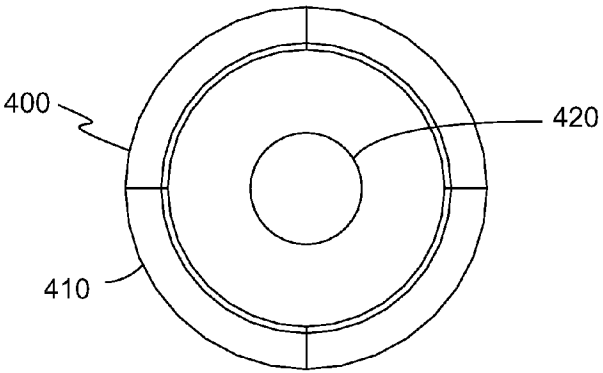
FIG. 25 is an end view of the floatation component in FIG. 24.
Figure 24:
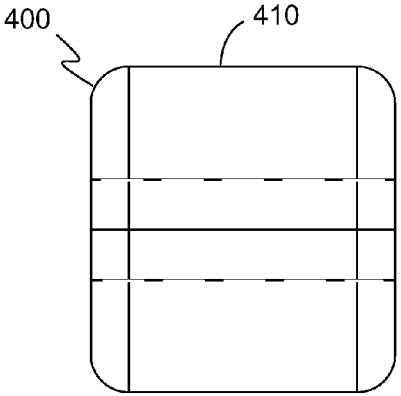
FIG. 24 is a side view of the floatation component in FIG. 23.

Turning now to FIGS. 23-25, there is illustrated another embodiment of the present invention. In this embodiment, clip system 10 not only includes first clip member 20A, second clip member 20B and tether member 60 but also a floatation component 400. Floatation component 400 is attached to and held by tether member 60. In this embodiment, floatation component 400 has a longitudinal through opening 420 into which central shank portion 62 of tether member 60 is received. Floatation component 400 is an air-entrapping structure that will keep the clip system 10 afloat if clip system 10 is inadvertently or accidently dropped into water or other liquid. In this embodiment, floatation component 400 is a foam cylinder having a predefined outer diameter and a predefined length sufficient to keep the clip system 10 afloat in a predefined liquid. Alternative embodiments include, but are not limited to, a floatation component 400 that is a cylindrical tube with an internal, sealed volume that contains/entraps air. It is further contemplated that floatation component 400 may be formed to include structural characteristics that allow floatation component 400 to attach to clip system 10 according to the previously disclosed structural characteristic configurations for connecting openable container 80 to tether member 60. FIGS. 24 and 25 disclose side views and end views, respectively, of the embodiment of floatation component 400 shown in FIG. 23. FIGS. 24 and 25 illustrate the outside diameter 410 and the inside diameter 420 of floatation component 400.

Although the preferred embodiments of the present invention have been described herein, the above description is merely illustrative. Further modification of the invention herein disclosed will occur to those skilled in the respective arts and all such modifications are deemed to be within the scope of the invention as defined by the appended claims.

What is claimed is:

1. A clip system comprising:

a first resilient clip member having a curved rear wall portion, an upper and a lower generally rectangular longitudinal finger gripping portion diverging forwardly from the curved rear wall portion in opposed relation, a rectangular portion being narrower than the finger gripping portion and extending at a forward end thereof in laterally opposed crossed relation, and an upper and a lower L-shaped jaw portion extending from the rectangular portion, each of which is wider than the rectangular portion wherein each finger gripping portion is sufficiently resilient that when pressed together by the fingers of an operator, the jaw portions will open and when released will be urged toward an abutted condition, the curved rear wall portion having a first aperture with a concave recess at an outer surface that (1) extends a predefined depth into the curved wall portion and (2) defines an internal angle between opposite surfaces forming the concave recess where a combination of the internal angle and the predefined depth of the concave recess permits an article extending through the first aperture to rotate and pivot within the concave recess of the first aperture, a slot extending from the first aperture to a second aperture located a predefined distance from the first aperture wherein the slot is narrower than the first aperture and the second aperture;

a tether member having a central shank portion of a first diameter, a first neck portion on a first end of the central shank portion and a second neck portion on a second end of the central shank portion, the first neck portion having a second diameter and being narrower than the central shank portion and having a thickness smaller than the slot in the first clip member and a first end portion connected to the first neck portion, wherein the first end portion is larger than the slot and larger than the first aperture but smaller than the second aperture, wherein the first neck portion extends through the first aperture of the first clip member, wherein the first end portion is disposed adjacent an inward side of the curved rear wall portion to retain the first clip member on the tether member and allow relative rotational and pivotal movement between the clip member and the tether member, and wherein the second end of the central shank portion is removably attachable to an article; and a detent comprising:

a detent support member extending transversely a predefined distance from an inner surface of the upper rectangular longitudinal finger gripping portion towards the lower rectangular longitudinal finger gripping portion and terminating in a support member end; and a detent tab attached to the detent support member between the inner surface and the support member end and extending transversely from the detent support member a predefined distance towards the curved rear wall portion adjacent to and aligned with the second aperture wherein the detent tab is positioned to engage the first end portion of the tether member when the first end portion enters through the second aperture and along the slot and to disengage with the first end portion as the first end portion advances past the detent tab to the first aperture while restricting egress of the tether member back past the detent tab to the second aperture, which egress cannot be achieved without user intervention requiring bending the detent tab sufficiently to allow the tether member to pass back to the second aperture.

2. The clip system of claim 1 wherein the detent tab is a bendable member.

3. The clip system of claim 1 further comprising a detent wherein the detent is a lip on a slot wall of the slot wherein the lip forms a slot portion that is narrower than the neck portion of the tether member to permit ingress of the end portion of the tether member from the second aperture to the inward side of the curved end and to restrict egress of the end portion back to the second aperture.

4. The clip system of claim 1 further comprising:

an openable container with a connector portion attached to a bottom surface of the openable container and having a through opening through the connector portion, wherein the tether member extends through the through opening to connect the openable container to the tether member; and a container entrance movable between a normally restricted position and an open position.

5. The clip system of claim 4, wherein the openable container is a resilient pouch with an elongated container entrance, the elongated container entrance having a first entrance end, a second entrance end, and an elongated entrance therebetween providing restricted access to an inside of the resilient pouch, wherein forcing the first entrance end toward the second entrance end provides unrestricted access to the inside of the resilient pouch.

6. The clip system of claim 5 wherein the elongated entrance is in an end of the resilient pouch.

7. The clip system of claim 5 wherein the elongated entrance is in a side of the resilient pouch.

8. The clip system of claim 4 wherein the openable container includes an outer sleeve and an inner housing defining an inside container volume, the inner housing being slidably received in the outer sleeve and slidable between an open position and a closed position, wherein the inner housing has an entrance communicating with the inside container volume and wherein the outer sleeve blocks the entrance to the inside container volume when the outer sleeve and the inner housing are in the closed position and wherein the entrance provides unrestricted access to the inside container volume when the outer sleeve and the inner housing are in the open position.

9. The clip system of claim 1 wherein the tether member has a stop extending from the outer surface of the central shank portion.

10. The clip system of claim 1 wherein the internal angle is selected from the group consisting of (1) a range of greater than 0° and less than 180°, (2) a range from about 45° to about 150°, and (3) a range from about 90° to about 130°.

11. The clip system of claim 10 wherein the internal angle is 120°.

12. The clip system of claim 1 further comprising a floatation component connected to the tether member.

13. The clip system of claim 1 further comprising:

a second clip member having a curved rear wall portion, an upper and a lower generally rectangular longitudinal finger gripping portion diverging forwardly from the curved rear wall portion in vertically opposed relation when viewed from the side, a rectangular portion being narrower than the finger gripping portion and extending at a forward end thereof in laterally opposed crossed relation, and an upper and a lower L-shaped jaw portion extending from the rectangular portion, each of which is wider than the rectangular portion wherein each of the finger gripping portions being sufficiently resilient that when pressed together by the fingers of an operator, the jaw portions will open and when released will be urged toward an abutted condition, the curved rear wall portion having a first aperture with a concave recess at an outer surface that (1) extends a predefined depth into the curved wall portion and (2) defines an internal angle between opposite surfaces forming the concave recess where a combination of the internal angle and the predefined depth of the concave recess permits an article extending through the first aperture to rotate and pivot within the concave recess of the first aperture, a slot extending from the first aperture to a second aperture located in the upper finger gripping portion adjacent the rear curved end wherein the slot is narrower than the first aperture and the second aperture, and a detent connected to the clip member and adjacent to the slot;

the tether member having a second neck portion connected on a second end of the central shank portion opposite the first neck portion, the second neck portion having a second diameter and being narrower than the central shank portion and having a thickness smaller than the slot in the second clip member, and a second end portion connected to the second neck portion wherein the second end portion is larger than the slot and larger than the first aperture but smaller than the second aperture, the second clip member being removably connectable to the tether member at the second neck portion; and a detent comprising:

a detent support member extending transversely a predefined distance from an inner surface of the upper rectangular longitudinal finger gripping portion towards the lower rectangular longitudinal finger gripping portion and terminating in a support member end; and a detent tab attached to the detent support member between the inner surface and the support member end and extending transversely from the detent support member a predefined distance towards the curved rear wall portion adjacent to and aligned with the second aperture wherein the detent tab is positioned to engage the first end portion of the tether member when the first end portion enters through the second aperture and along the slot and to disengage with the first end portion as the first end portion advances past the detent tab to the first aperture while restricting egress of the tether member back past the detent tab to the second aperture, which egress cannot be achieved without user intervention requiring bending the detent tab sufficiently to allow the tether member to pass back to the second aperture.

14. A method of connecting a clip to a tether, the method comprising:

providing a first resilient clip member having a curved rear wall portion, an upper and a lower generally rectangular longitudinal finger gripping portion diverging forwardly from the curved rear wall portion in opposed relation, a rectangular portion being narrower than the finger gripping portion and extending at a forward end thereof in laterally opposed crossed relation, and an upper and a lower L-shaped jaw portion extending from the rectangular portion, each of which is wider than the rectangular portion wherein each finger gripping portion is sufficiently resilient that when pressed together by the fingers of an operator, the jaw portions will open and when released will be urged toward an abutted condition, the curved rear wall portion having a first aperture with a concave recess at an outer surface that (1) extends a predefined depth into the curved wall portion and (2)

defines an internal angle between opposite surfaces forming the concave recess where a combination of the internal angle and the predefined depth of the concave recess permits an article extending through the first aperture to rotate and pivot within the concave recess of the first aperture, a slot extending from the first aperture to a second aperture located in the upper finger gripping portion adjacent the rear curved end wherein the slot is narrower than the first aperture and the second aperture, and a detent connected to the clip member and adjacent to the slot;

providing a tether member having a central shank portion of a first diameter, a first neck portion on a first end of the central shank portion, the first neck portion having a second diameter and being narrower than the central shank portion and having a thickness smaller than the slot in the first clip member, and a first end portion connected to the first neck portion wherein the first end portion is larger than the slot and larger than the first aperture but smaller than the second aperture;

providing a detent comprising:

a detent support member extending transversely a predefined distance from an inner surface of the upper rectangular longitudinal finger gripping portion towards the lower rectangular longitudinal finger gripping portion and terminating in a support member end; and a detent tab attached to the detent support member between the inner surface and the support member end and extending transversely from the detent support member a predefined distance towards the curved rear wall portion adjacent to and aligned with the second aperture wherein the detent tab is positioned to engage the first end portion of the tether member when the first end portion enters through the second aperture along the slot and to disengage with the first end portion as the first end portion advances past the detent tab to the first aperture while restricting egress of the tether member back past the detent tab to the second aperture, which egress cannot be achieved without user intervention requiring bending the detent tab sufficiently to allow the tether member to pass back to the second aperture;

inserting the first end portion of the tether member through the second aperture; and moving the first neck portion of the tether member along the slot to the first aperture and past the detent adjacent the slot wherein the detent restricts movement of the tether member back to the second aperture.

15. A method of maintaining articles releasably clipped together using a clip system, the method comprising:

providing a first resilient clip member and a second resilient clip member each of the clip members having a curved rear wall portion, an upper and a lower generally rectangular longitudinal finger gripping portion diverging forwardly from the curved rear wall portion in opposed relation, a rectangular portion being narrower than the finger gripping portion and extending at a forward end thereof in laterally opposed crossed relation, and an upper and a lower L-shaped jaw portion extending from the rectangular portion, each of which is wider than the rectangular portion wherein each finger gripping portion is sufficiently resilient that when pressed together by the fingers of an operator, the jaw portions will open and when released will be urged toward an abutted condition, the curved rear wall portion having a first aperture with a concave recess at an outer surface that (1) extends a predefined depth into the curved wall portion and (2) defines an internal angle between opposite surfaces forming the concave recess where a combination of the internal angle and the predefined depth of the concave recess permits an article extending through the first aperture to rotate and pivot within the concave recess of the first aperture, a slot extending from the first aperture to a second aperture located a predefined distance from the first aperture wherein the slot is narrower than the first aperture and the second aperture, and a detent connected to the clip member and adjacent to the slot;

providing a tether member having a central shank portion of a first diameter, a neck portion on opposite ends of the central shank portion, each neck portion having a second diameter and being narrower than the central shank portion and having a thickness smaller than the slot in the first and second clip members, and an end portion connected to the neck portion at opposite ends thereof wherein the end portion is larger than the slot and larger than the first aperture but smaller than the second aperture wherein one of the neck portion extends through the first aperture of the first clip member and the other of the neck portion extends through the first aperture of the second clip member wherein the end portion is disposed adjacent an inward side of each curved rear wall portion to rotatably retain each of the clip members on the tether member in axially opposed relation and allow relative rotational and pivotal movement between each of the clip members and the tether member;

providing, with each of the first resilient clip member and the second resilient clip member, a detent comprising:

a detent support member extending transversely a predefined distance from an inner surface of the upper rectangular longitudinal finger gripping portion towards the lower rectangular longitudinal finger gripping portion and terminating in a support member end; and a detent tab attached to the detent support member between the inner surface and the support member end and extending transversely from the detent support member a predefined distance towards the curved rear wall portion adjacent to and aligned with the second aperture wherein the detent tab is positioned to engage the first end portion of the tether member when the first end portion enters through the second aperture along the slot and to disengage with the first end portion as the first end portion advances past the detent tab to the first aperture while restricting egress of the tether member back past the detent tab to the second aperture, which egress cannot be achieved without user intervention requiring bending the detent tab sufficiently to allow the tether member to pass back to the second aperture;

inserting one end portion of the tether member through the second aperture of the first clip member;

moving the one neck portion of the tether member along the slot to the first aperture and past the detent adjacent the slot wherein the detent restricts movement of the tether member back to the second aperture;

inserting the other end portion of the tether member through the second aperture of the second clip member; and moving the other neck portion of the tether member along the slot of the second clip member to the first aperture and past the detent adjacent the slot wherein the detent restricts movement of the tether member back to the second aperture.

16. The method claim 15 further comprising connecting a connector portion attached to a bottom surface of an openable container to the central shaft portion of the tether member, wherein the connector portion has a through opening and the tether member extends through the through opening to connect the openable container to the tether member, the openable containing having a container entrance movable between a normally closed position and an open position.

17. The method of claim 15 further comprising connecting a floatation component to the central shaft portion of the tether member.

* * * * *